US005493734A

United States Patent [19]

Nieves-Rivera

[11] Patent Number: 5,493,734

[45] Date of Patent: Feb. 27, 1996

[54] NECK SHIELD ATTACTMENT FOR HELMET

[75] Inventor: Orlando Nieves-Rivera, Callejones Lares, Puerto Rico

[73] Assignee: Commonwealth of Puerto Rico, San Juan, Puerto Rico

[21] Appl. No.: 159,230

[22] Filed: Nov. 30, 1993

[51] Int. Cl.[6] ..... A42B 3/04

[52] U.S. Cl. ..... 2/209.13; 2/48; 2/172; 2/181.4; 2/207

[58] Field of Search ..... 2/50, 51, 52, 48, 2/172, 181, 181.2, 181.4, 205, 206, 207, 209.13, 410, 422, 423, 909, 918, 416, 417

[56] References Cited

U.S. PATENT DOCUMENTS

| | | | |
|---|---|---|---|
| 1,863,527 | 6/1932 | Stern | 2/48 |
| 2,025,772 | 12/1935 | Punton . | |
| 3,055,012 | 9/1962 | Aileo . | |
| 3,100,896 | 8/1963 | Khanbegian . | |
| 3,825,952 | 7/1974 | Pershing et al. . | |
| 4,180,868 | 1/1980 | Snow . | |
| 4,887,319 | 12/1989 | Daniels . | |
| 5,161,259 | 11/1992 | Shorts | 2/172 |
| 5,212,837 | 5/1993 | Gose et al. | 2/172 |

FOREIGN PATENT DOCUMENTS

| | | | |
|---|---|---|---|
| 707899 | 7/1941 | Germany | 2/48 |

*Primary Examiner*—Diana Biefeld

*Attorney, Agent, or Firm*—Oblon, Spivak, McClelland, Maier & Neustadt

[57] ABSTRACT

An environmental shield secureable to a helmet, protecting a wearer. The helmet includes a rigid outer shell and a perforate liner positioned within the outer shell, leaving a space between a portion of the outer shell and the liner. The environmental shield can include a flexible sheet like main portion that shields the wearer when worn secured to the helmet. This shield includes an attaching portion of the main portion that is configured to secure the shield to the liner of the helmet in such a way that preserves the space between the liner and helmet so that air can flow into the helmet. Alternatively, the environmental shield can include a quadrilaterally shaped flexible sheet like main portion. This shield has two elongated flaps along one side of the main portion. Receded regions extend along adjacent sides from the flaps, and sloped so that the width of the shield increases. Shoulders protrude from the receded regions increasing the shield's width. Extensions are extended from the shoulders to a side opposite the flaps, and sloped so that the width of the shield increases. An arcuate edge defines the bottom of the shield. In any alternative embodiment the shield may be provided to include the helmet.

15 Claims, 5 Drawing Sheets

NECK SHIELD ATTACTMENT FOR HELMET

BACKGROUND OF THE INVENTION

1. Field of the Invention

The field of the invention relates to an environmental shield, and, more particularly, to an environmental shield to be used with a helmet for protecting a wearer from environmental elements.

2. Description of the Related Art

The present invention has applicability to a wide range of related fields in which individuals wear protective helmets. Particularly, labor-intensive jobs may expose helmeted workers at some job sites to harsh environmental conditions. Helmeted military personnel may also be exposed to harsh environments when they are deployed in scorched deserts or insect infested marsh or jungle areas. The present invention is also useful in any situation in which a person needs to be shielded from environmental conditions, such as in household construction or gardening.

Labor intensive work is often conducted outside, exposing workers to harsh, environmental elements. The back of the neck, shoulders and sides of the face, especially the cheeks, are the most exposed part of a helmeted worker's body, because labor often requires a person to stoop or lean over. These exposed areas of the skin are subject to, for example, racking sunburn, stinging insect bites and whipping winds carrying sands. In colder climates, the exposed areas are subjected to bitter cold, and wind driven snow or sleet.

Similarly, military personnel are subjected to harsh environmental conditions requiring protection for the same exposed areas of the body. In a swamp and jungle environment, the back of the neck is especially vulnerable to blood thirsty parasites. Parasites are especially troublesome for soldiers because they have their hands full carrying weapons so that they are unable to swat insects away. In arctic conditions, soldiers require warmth to protect exposed areas of the body from frost bite. During desert military strikes, the same exposed areas of the body need protection from the blazing sun and sand blasting winds.

Sunburn is a primary concern to those exposed to harsh environmental conditions, such as laborers and military personnel. Sunburn causes a painful rash on the skin, making sleeping and bathing unbearable. More importantly, advanced sunburn can develop into skin cancer. Since laborers and military personnel are often in the sun, they are particularly subject to skin cancer, primarily in those places of the body that are exposed. Repeated exposure to the sun will complicate any case of skin cancer, which may lead to death.

The number of cases of skin cancer reported each year is rising. Scientific authorities, such as NASA, have announced that the ozone layer is being depleted by hydrocarbon contamination. It is known that the ozone layer filters out the sun's harmful ultraviolet rays which cause skin cancer. The medical community generally believes that the depletion of the ozone layer has caused the rise in cancer rates.

It is likely that the ozone layer will continue to be depleted as the world becomes even more industrialized and emits greater quantities of hydrocarbons. Therefore, we can expect even greater rates of skin cancer in the coming years. Those who spend substantial amounts of time in the sun, such as laborers or military personnel, will bear the greatest risk. The invention of an environmental shield to protect these people from skin cancer is urgently needed.

In addition to protecting all of the exposed body areas mentioned above, an environmental shield must be comfortable and convenient to the wearer in order to ensure that it is used. In hot weather, the environmental shield should be adequately vented so that a wearer does not become overheated. Since a person's head radiates a significant amount of heat, an environmental shield should not substantially cover the crown of the wearer's head beneath the protective helmet. In cold weather, an environmental shield should provide warmth, trapping warm air in a pocket between the environmental shield and the wearer's helmeted head, neck and shoulders.

Further, such an environmental shield should stay firmly attached to the wearer's helmet even in very windy or turbulent weather so that the shield is not frustrating to wear and so that it does not cause accidents by blocking the wearer's vision. However, the shield should simultaneously be loose fitting, comfortable to wear, and should easily permit a person to move his head vigorously in several directions, as is often required in labor and military maneuvers.

In addition, the environmental shield should have qualities that allow broad use of the shield in a number of fields. For example, the shield should be formed so that it is easily detachable from a helmet for ease of cleaning. The shield should also be attachable to any type of helmet having a suitable lining. Further, the shield should be made of a fabric that is readily manufactured in different sizes, accommodates different environmental conditions, can be inexpensively made for smaller markets, and can be readily colored for the purposes of coding, camouflage, or reflecting and absorbing light.

Presently, no environmental shield exists that meets all of the above needs. Prior devices either inadequately cover the above-mentioned exposed areas, do not provide adequate ventilation, cover too large a portion of the wearer's head, are too expensive to manufacture or inconvenient to use.

For example, attention is directed to U.S. Pat. No. 3,825,952 issued to Pershing et al in which a skirted helmet is disclosed. Pershing et al teaches the use of a rectangular piece of material, that totally encloses and seals in the head of a wearer. A person attempting strenuous work while wearing this skirted helmet, with head totally sealed within the helmet, would overheat, as no proper ventilation is disclosed.

Moreover, Pershing et al also discloses that the skirted helmet only covers the upper neck. This device inadequately protects the exposed areas of the body, mentioned above, such as the lower neck and shoulders.

U.S. Pat. No. 4,180,868 issued to Snow discloses an all-weather hat accessory, including an outer material tensionally fitted over the outside of a helmet, a face piece, and pockets to be filled with liquid coolant inserts.

The device of Snow is also inadequate for use in labor intensive work and military operations, as contemplated for the present invention. Snow discloses that the outer material attaches over the outside of the hat. Although the entire head is not enclosed, the only source of ventilation is through the front of the hat. This enclosure of the head, even though not complete, would trap excessive heat within the hat. In addition, the face piece of Snow would further trap heat in the helmet. Finally, the coolant inserts are bulky and would cause the wearer to be uncomfortable during vigorous activity.

U.S. Pat. No. 2,025,772 issued to C. W. Punton discloses protective head gear, using elastic ribs that are in direct contact with the wearer's head and which attach to a main elastic portion that fits around the rest of the head, attaching tightly under the jaw.

The device of C. W. Punton is also inadequate for use by active laborers and military personnel. This device fits tightly around the wearer's head, with ribs extending substantially over the crown of the wearer's head to absorb shock. Such an arrangement would cause an active person to become hot and uncomfortable during manual labor as the tight fitting elastic does not allow adequate transfer of heat from a wearer's head.

In summary, the prior art does not disclose any device which meets the needs of a helmet mounted environmental shield for labor intensive work.

SUMMARY OF THE INVENTION

In accordance with the present invention, an environmental shield is provided that is securable to a helmet for protecting a wearer. The helmet that the shield is secured to should be chosen to a have a rigid outer shell and a perforate liner positioned within the outer shell such that a space remains between at least a portion of the rigid outer shell and the perforate liner. In a first embodiment, the environmental shield is comprised of a flexible sheet like main portion with an associated attaching portion configured to secure the shield to the perforate helmet in such a way that air can flow into the space between the outer shell and the helmet liner when the shield is attached to the helmet.

Other objects, features, and advantages of the present invention are demonstrated in a second embodiment. The shield in this embodiment is comprised of a flexible sheet like main portion having a generally quadrilateral shape including a center, opposite first and second sides, a width measured along a lateral axis substantially parallel to first and second sides, and opposite third and fourth sides. Two generally elongated flaps extend from opposite ends of the first side of the shield, the flaps defining securement portions for securing the shield to the perforate liner of the helmet. Receded regions on the third and fourth sides extend from the flaps, sloping away from the center of the shield's main portion in the direction from the first side to the second side. Shoulders protrude from the receded regions such that the width of the shield at the shoulders is greater than any width of the shield at the receded regions. Extensions extend from the shoulders to the second side of the shield and are sloped away from the center of the shield in a direction from the first side to the second side such that a width of the shield at the extension is wider than any width at the receded regions. An arcuate edge defines the second side of the shield connecting the extensions.

Other objects, features, and advantages of the present invention are demonstrated in a third embodiment. This embodiment is an environmental assembly including the environmental shield of the first embodiment but also provides a helmet including a rigid outer shell and perforate liner positioned within the outer shell such that a space remains between at least a portion of the rigid outer shell and the perforate liner.

It is one object of the present invention to provide an environmental shield adapted to be removably secured to a particular helmet.

Another object of the iivention is to provide an environmental shield that is easily detached from a helmet so that it may be cleaned.

Another object of the invention is to provide an environmental shield attachable to any helmet having a suitable lining.

Another object of the invention is to provide an environmental shield that can be made in a variety of sizes and from a variety of fabrics to accommodate differing conditions, markets, and people.

Another object of the invention is to provide an environmental shield that can be made in different colors, for color coding, camouflage, and reflecting or absorbing light.

Another object of the invention is to provide an environmental shield that adequately ventilates the head of a wearer.

Another object of the invention is to protect a wearer while not substantially covering the crown of the head.

Another object of the invention is to provide an environmental shield that adequately protects the exposed areas of the body and is well ventilated, comfortable to wear and not bulky.

Other objects, features, and advantages of the present invention will become apparent from the following detailed description. It should be understood, however, that various changes and modifications within the spirit and scope of the invention will become apparent to those skilled in the art from this detailed description.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
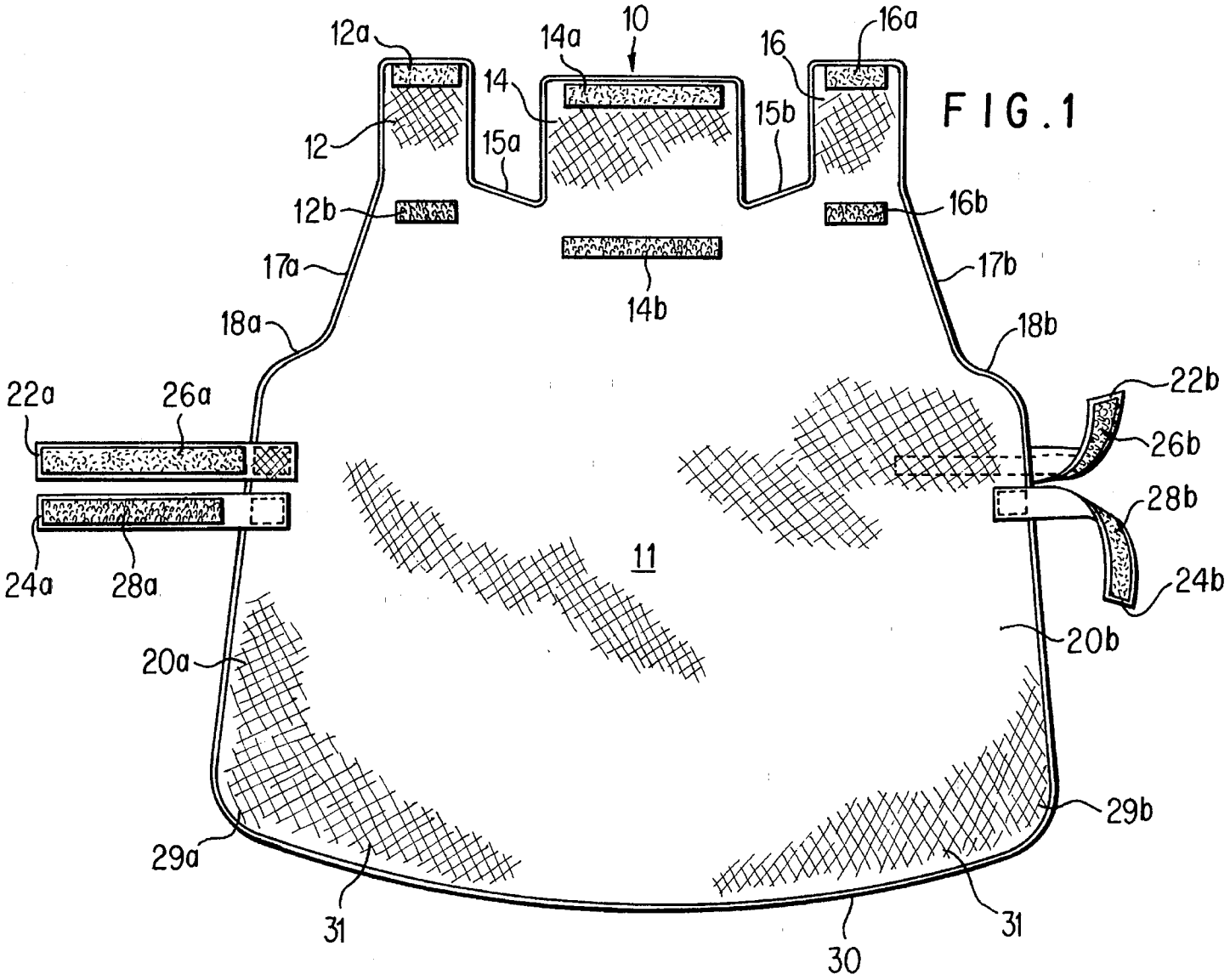
FIG. 1 is a plan view of the environmental shield of the invention.

An environmental shield 10 according to the invention is shown in FIG. 1. The shape of the shield 10 is generally quadrilateral, having a center 11 and two sets of opposite sides. The sides of the shield 10 are referred to as left, right, top, and bottom sides, corresponding with the illustration of FIG. 1. The shield 10 has a width measured along a lateral axis substantially parallel to the top and bottom sides. The shield 10 should be made out of a sheet like fabric that is flexible, inexpensive, and is available in a variety of colors, for example, the shield 10 is made out of fabrics such as cotton, denim, or rayon. The shield 10 may also be made out of fabrics having an SPF, sun protective factor, rating for blocking ultra-violet radiation. In military operations, fabrics such as KEVLAR™ may be employed.

The top of the shield 10 has attaching portions comprising left, middle and right flaps 12, 14 and 16 respectively. The left flap 12 is connected to the middle flap 14 via a left bridge 15*a* that is sloped downward toward the bottom of the shield 10 in the direction from the left flap 12 to the middle flap 14. A right bridge 15*b* connects the middle flap 14 to the right flap 16 and is sloped upward toward the top of the shield 10 in the direction from the middle flap 14 to the right flap 16.

Each flap has the same length with respect to the left and right sides of the shield 10, but the middle flap 14 has a longer width than the other flaps with respect to the top and bottom sides of the shield 10.

Three pairs of securing devices 12*a*, 12*b*, 14*a*, 14*b*, 16*a* and 16*b* are fixed to the shield 10 where securing devices 12*a*, 14*a* and 16*a* of each pair are fixed to the top of each flap.

From the top of the shield 10, where each flap is attached, each side of the shield 10 slopes downward and outward forming receded regions comprising left and right receded temple regions 17*a* and 17*b* that meet shoulders comprising left and right cheek guards 18*a* and 18*b*. Each cheek guard forms the top of a left and right extension comprising wind retarding extensions 20*a* and 20*b*.

Each wind retarding extension 20*a* and 20*b* has a pair of upper and lower fastening belts 22*a*, 22*b*, 24*a* and 24*b* respectively having securing devices 26*a*, 26*b*, 28*a* and 28*b*. The fastening belts 22*a* and 24*a* on the left side wind retarding extension 20*a* are longer than the fastening belts 22*b* and 24*b* on the right wind retarding extension 20*b*.

The left side fastening belts 22*a* and 24*a* and the lower right side fastening belt 24*b* are stitched to one surface of the shield 10, whereas the upper right side fastening belt 22*b* is stitched to the opposite surface of the shield 10.

The securing devices on the flaps and the fastening belts are preferably of VELCRO™, a well known and readily available friction fastener which utilizes interengaging loops and hooks. The securing devices may also be buttons or magnetic strips that affix to each other. The securing devices on the right side fastening belts 22*b* and 24*b* are fixed on one surface of the shield 10 and the securing devices on the left side fastening belts 22*a* and 24*a* are on the other surface of the shield 10 so that when upper fastening belts 22*a* and 22*b* are attached to each other and lower fastening belts 24*a* and 24*b* are attached to each other they are flush against the chest of a wearer.

Each wind retarding extension ends in rounded knees 29*a* and 29*b*. The shield 10 is completed by an arcuate edge or bottom 30, bridging left and right knees 29*a* and 29*b*.

In an alternative embodiment schematically illustrated in FIG. 1, weights 31 may be inserted into the body of the shield 10 to prevent wind from lifting the shield 10 from the body of a wearer.

In yet another embodiment, the material of the shield 10 may be comprised of a material having an ultra-violet light resistive characteristic for blocking ultra-violet light from penetrating the shield 10.

Figure 2A:
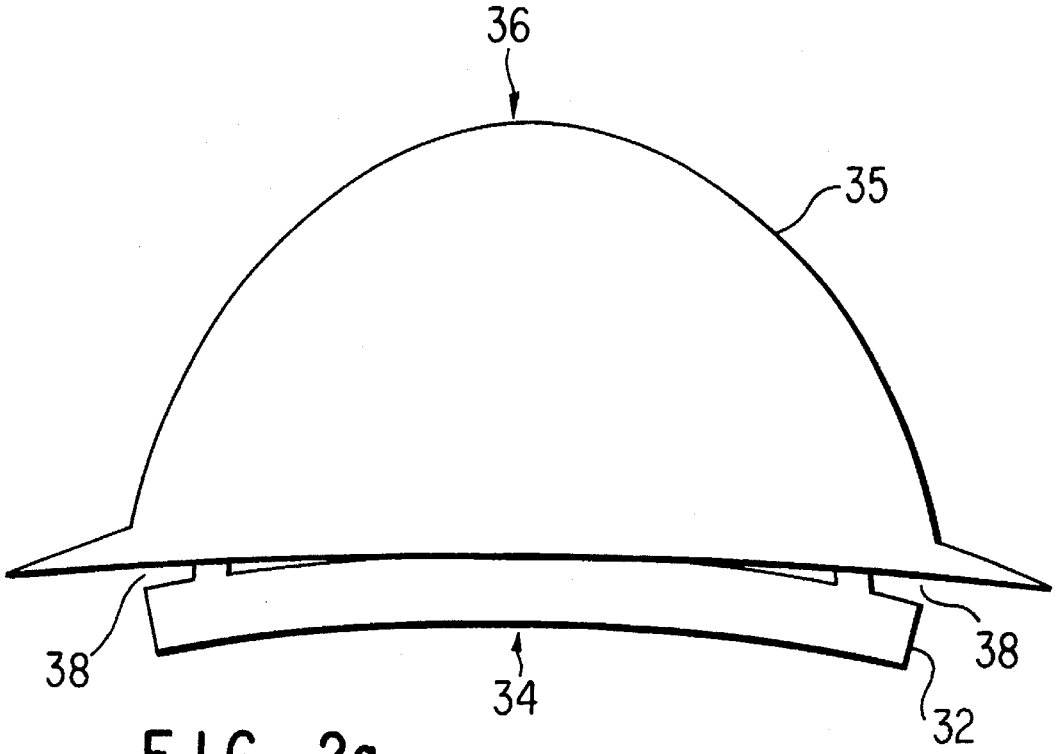
FIG. 2*a* is a side view of a conventional protective helmet with a perforate liner.
Figure 2B:
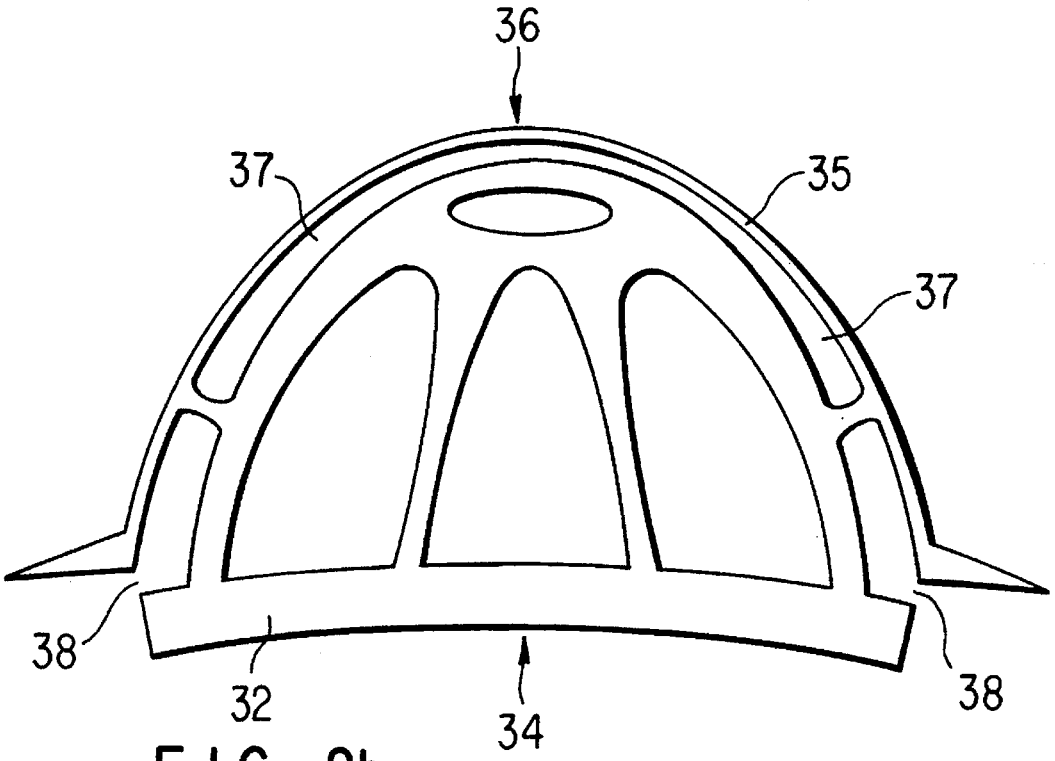
FIG. 2*b* is a cut-away view of the helmet of FIG. 2*a* exposing the perforate liner within the helmet.

FIGS. 2*a* and 2*b* show a conventional helmet. The shape of this helmet is illustrative of those used in the construction industry, but military style helmets could also be used. FIG. 2*b* depicts a cut-away view of the helmet in FIG. 2*a* exposing the perforate liner 32. Helmet 36 includes an outer protective shell 35 that is rigid and a perforate liner 32 that is attached within the outer shell 35. The liner 32 is attached to the outer shell 35 such that a space 38 is formed between the liner 32 and the inside of the outer shell 35 including a ventilation area 37. The helmet 36 is fitted on a person's head, enclosing the head within opening 34, the head in contact with the liner 32 which is connected to the outer shell 35 and supports the helmet 36. When the helmet 36 is jarred, the shock is absorbed by the liner 32 and not the wearer's head.

Figure 3:
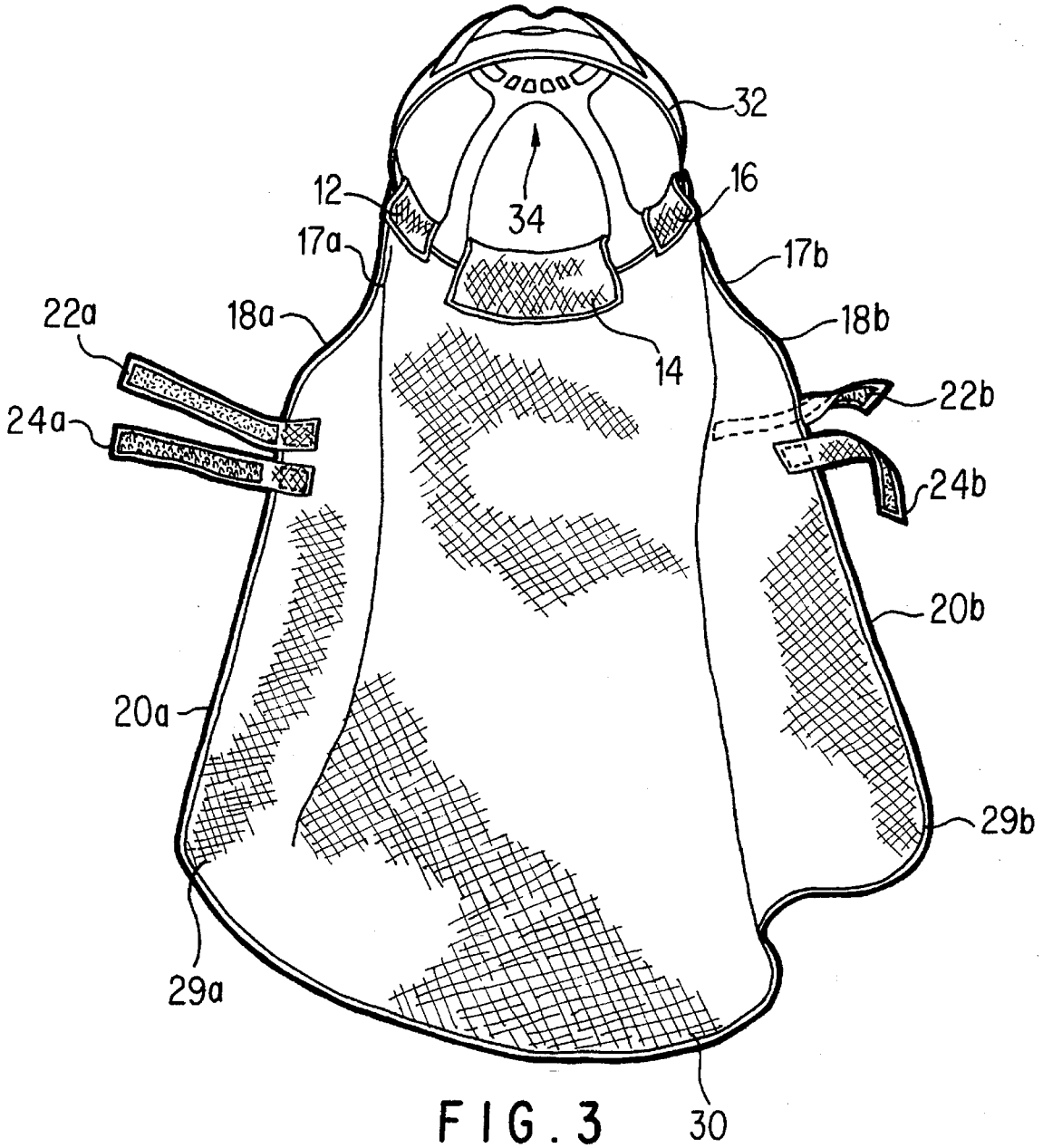
FIG. 3 is a perspective illustration of the environmental shield of the invention attached to a perforate helmet liner of the type illustrated in FIG. 2*b;*

In FIG. 3, the environmental shield of the invention 10 is shown attached to a perforate liner 32 of a conventional helmet 36 like that shown in FIGS. 2*a* and 2*b*. The liner 32 is shown from the front and slightly tilted upward to show an opening 34, where a wearer's head fits. As shown in FIG. 2*b*, the liner 32 is attached within a helmet 36, but leaving a space 38 between the liner 32 and the outer shell 35 of the helmet 36.

The environmental shield 10 attaches to a helmet 36 by attaching portions including left, middle and right flaps 12, 14 and 16. The flaps fold over portions of a perforate liner 32 inside the outer shell 35 of a helmet 36. The securing devices 12*a*, 14*a* and 16*a* are joined with securing devices 12*b*, 14*b* and 16*b* respectively, securing the flaps, and thus the environmental shield 10 to the helmet 36.

The flaps are arranged so that the space 38 between the outer shell 35 and the liner 32 of the helmet 36 is preserved. This flap folding arrangement allows air to ventilate over the shield 10, and through a space 38 between the helmet shell 35 and the liner 32, to cool a wearer's head while performing strenuous activities.

The middle flap 14 is attached to the shield 10 at a point which is closer to the arcuate bottom 30 than the points at which the left and right flaps 12, 16 are attached to shield 10. As the flaps are attached around the liner 32, having an annular circumference, the flaps hold the shield 10 smoothly around a wearer's head, preventing the shield 10 from puckering. Moreover, the left and right bridges 15*a*, 15*b*, which connect the flaps, will be flush against a parallel section of the liner 32.

Left and right receded temple regions 17*a*, 17*b* cover the temple area of a wearer's head, yet recede so that a wearer can see to the side without turning of the head.

Left and right wind retarding extensions 20*a* and 20*b* cover the side of a wearer's face. Left and right cheek guards 18*a* and 18*b* of the wind retarding extensions cover a wearer's cheeks. It has been found by experimentation that the wind retarding extensions 20*a*, 20*b* help prevent wind from lifting the shield 10 from a wearer's body.

Fastening belts 22*a*, 22*b*, 24*a* and 24*b* are attached to the wind retarding extensions 20*a* and 20*b* of the shield 10 and extend around a wearer's chest where the belts are joined. The belts are joined together by securing devices 26*a*, 26*b*, 28*a* and 28*b*, preferably VELCRO™, mounted on opposite surfaces of each joined pair of belts so that the belts lie flush against a wearer. The upper right side fastening belt 22*b* is stitched to a surface opposite the surface of the shield 10 to which the other belts are stitched to, so that the belts pull evenly on the shield 10 when joined.

The fastening belts 22*a*, 22*b*, 24*a* and 24*b* prevent the shield 10 from lifting from a wearer's body when fastened, directly pulling on the wind retarding extensions 20*a* and 20*b*. In addition, the fastening belts 22*a*, 22*b*, 24*a* and 24*b* serve to secure the shield 10 to the body of a wearer so that vigorous movement will not shake the shield 10 loose or cause the shield 10 to inhibit the movement and sight of a wearer.

The shield 10 drapes over the back of a wearer's neck and extends liberally past the top of the wearer's shoulders. The shield 10 ends in a bottom 30 which is arcuate. It has been found through experimentation that this arcuate bottom 30 helps to prevent wind from lifting the shield 10.

In addition, knees 29*a* and 29*b* also help prevent wind from lifting the shield 10 from a wearer's body because they are rounded, not square, thus reducing the amount of material the wind can influence.

Further, the bottom 30 is arcuate shaped so that the shield 10 conforms to an arcuate shaped back when the shield is worn preventing the shield 10 from puckering.

In this manner, the environmental shield 10 provides excellent protection to the exposed area of a laboring body, e.g. the back of the neck, sides of the face, and the shoulders, while providing good ventilation, good visibility and is comfortable to wear.

When the helmet 36 is worn by a wearer the helmet 36 is fitted onto a wearer's head within opening 34. Flaps 12, 14 and 16 secure the shield 10 to the perforate liner 32. The shield 10 drapes down the wearer's back, over the shoulders, and covers the sides of the face. Fastening belts 22*a*, 22*b*, 24*a* and 24*b* secure the shield to the wearer.

Figure 4:
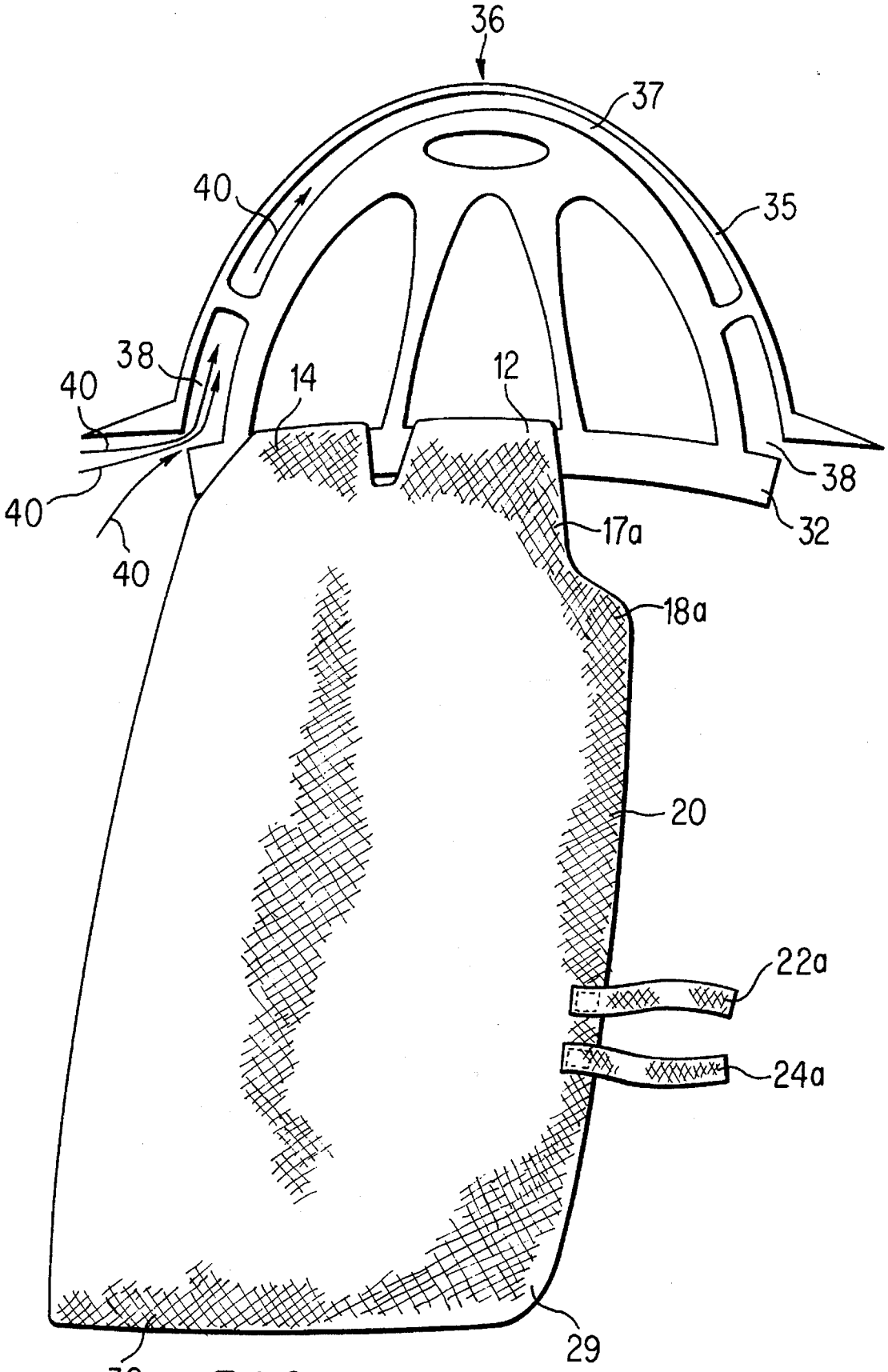
FIG. 4 is a cut-away side view of the environmental shield of the invention showing it attached to a perforated helmet liner.

FIG. 4 shows a portion of the helmet 36 cut-away, exposing the shield 10 attached to the liner 32 of a helmet 36. This Figure demonstrates the ventilation of the wearer's head.

Air streams 40 flow freely over the environmental shield 10, through the space 38, between the outer shell 35 of the helmet 36 and the liner 32 and into ventilation area 37. This arrangement, as discussed above, provides superior ventilation of a wearer's head over the prior art.

Figure 5:
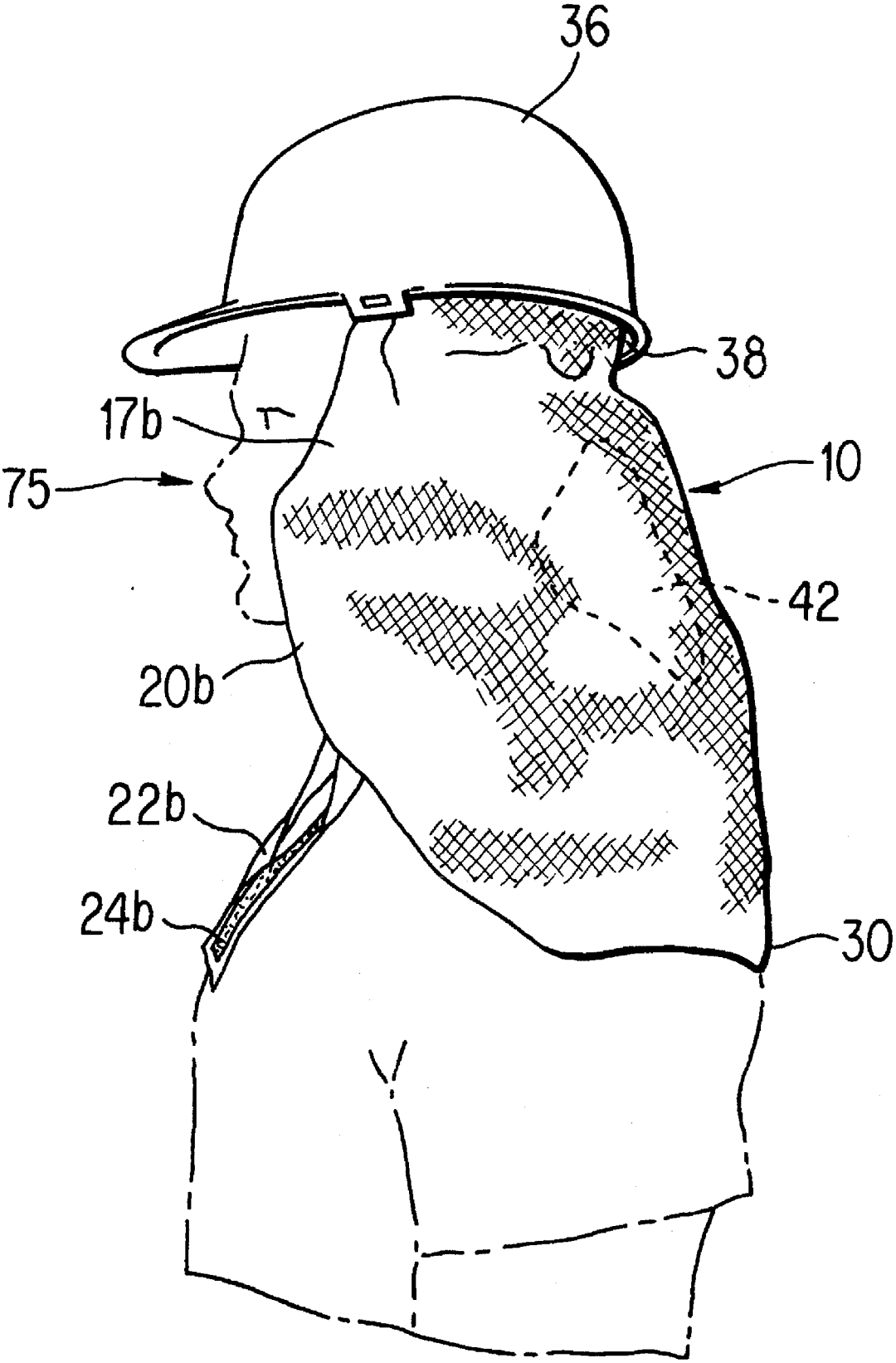
FIG. 5 is an illustration of the environmental shield of the invention in use.

FIG. 5 shows the environmental shield 10 in use by a wearer 75. The shield 10 attaches to the inside of the helmet 36, leaving a ventilation space 38. The shield 10 is draped comfortably over the back of the neck of a wearer 75 and extends liberally over the wearer's shoulders where the shield 10 comes to an arcuate bottom 30. Receding temple region 17*b* covers the temple of a wearer, yet allows the wearer to see to the side without turning the head. Wind retarding extension 20*b* covers the side of the face and cheek guard 18*b* covers the cheek. Right side fastening belts 22*b* and 24*b* are shown lying across the chest of a wearer 75. An air pocket 42 exists between shield 10 and the body of the wearer 75, and is formed as the shield 10 drapes down the wearer's body.

In warm weather, air 40 passes into the helmet 36 through the ventilation space 38 thereby keeping a laboring body cool.

In cool weather, the air pocket 42 acts as a barrier of air that insulates the exposed areas of a wearer's body from the cold. An advantage to using air as an insulator is that trapped air is known to be as excellent an insulator as synthetic insulations. Further, a wearer's body will tend to warm the air trapped in the pocket 42 keeping the wearer even warmer.

Thus, a comfortable environmental shield 10 that is adequately vented to cool an overheated wearer yet insulated to warm a chilled wearer is achieved by the disclosed invention, protecting the exposed areas of a wearer 75.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An environmental shield in combination with a helmet for securing the shield to the helmet for protecting a wearer, the helmet including a rigid outer shell and a perforate liner positioned within the outer shell such that a space remains between at least a portion of the rigid outer shell and the perforate liner, the environmental shield comprising:

a flexible sheet like main portion which shields a wearer of the helmet when the environmental shield is secured to the helmet; and an attaching portion associated with the main portion and configured to secure the environmental shield to the perforate liner such that air can flow into the space between the rigid outer shell and the perforate liner when the environmental shield is attached to the helmet;

wherein the attaching portion comprises at least one flap which extends from one side of the main portion of the shield by an extent sufficient to permit the flap to be folded around a portion of the perforate liner to permit the environmental shield to be secured to the perforate liner, and wherein said air flow into said space is not obstructed when said at least one flap is folded around the portion of said perforate liner;

wherein the main portion further comprises insertable weights for preventing the shield from lifting off a wearer's body.

2. An environmental shield according to claim 1 wherein the attaching portion further comprises:

a pair of securing devices for the flap, a first securing device of the pair positioned at a distal end of the flap, a second securing device of the pair positioned adjacent to the main portion, the first and second securing devices of the pair being securable to each other when the flap is folded around the perforate liner to secure the shield to the helmet.

3. An environmental shield according to claim 2, wherein the securing devices further comprise:

strips of loop and hook fasteners which are securable with each other.

4. An environmental shield according to claim 1, wherein the main portion further comprises:

a fastening belt extending from the main portion and comprising means for securing the shield to the body of a wearer when the shield is worn.

5. An environmental shield for securement to a helmet for protecting a wearer, the helmet including a rigid outer shell and perforate liner positioned within the outer shell such that a space remains between at least a portion of the rigid outer shell and the perforate liner, the environmental shield comprising:

a flexible sheet like main portion having a generally quadrilateral shape including a center, opposite first and second sides, a width measured along a lateral axis substantially parallel to the first and second sides, and opposite third and fourth sides;

two generally elongated flaps extending from opposite ends of the first side of the shield and defining securement portions for securing the shield to the perforate liner of the helmet;

receded regions on both third and fourth sides that extend from the flaps and slope away from the center of the main portion in the direction from the first side to the second side;

shoulders that protrude from the receded regions such that a width of the shield at the shoulders is greater than any width of the shield at the receded regions;

extensions that extend from the shoulders to the second side of the shield and are sloped away from the center of the shield in a direction from the first side to the second side such that a width of the shield at the extension is wider than any width at the receded regions; and an arcuate edge defining the second side of the shield connecting the extensions;

a third flap is located centrally on the first side, wherein the first side forms bridges separating the flaps;

the bridges being sloped such that, when the flaps connect the shield to the perforate liner of the helmet, the first side of the shield will be substantially parallel to the bottom of the helmet.

6. An environmental shield according to claim 5, wherein the shield further comprises:

rounded knees extending from the extensions to the second side of the shield; and fastening belts extending from alternate surfaces of each of said third and fourth sides of the shield.

7. An environmental shield according to claim 6, wherein the flaps and the fastening belts each include securing means for securing the flaps to the liner and for securing the fastening belts to each other.

8. An environmental shield according to claim 7, wherein the securing means comprises strips of loop and hook fasteners which are matable to each other.

9. An environmental shield according to claim 5, wherein the receded regions are sufficiently receded so that a wearer's vision is not hindered and further comprise temple regions that cover a wearer's temple area when the shield is worn.

10. An environmental shield according to claim 5, wherein the shoulders comprise:

cheek guards extending sufficiently to cover a wearer's cheeks when the shield is worn.

11. An environmental assembly for protecting a wearer comprising:

a helmet including a rigid outer shell and perforate liner positioned within the outer shell such that a space remains between at least a portion of the rigid outer shell and the perforate liner;

a flexible sheet like main portion which shields the wearer of the helmet when the environmental shield is secured to the helmet; and an attaching portion associated with the main portion and configured to secure the environmental shield to the perforate liner such that air can flow into the space between the rigid outer shell and the perforate liner when the environmental shield is attached to the helmet;

wherein the attaching portion comprises a flap, extending from the main portion of the shield by an extent sufficient for the flap to be folded around a portion of the perforate liner to secure the environmental shield to the perforate liner, and wherein said air flow into said space is not obstructed when said flap is folded around the portion of said perforate liner;

wherein the main portion further comprises:

a receded temple region that extends from the perforate liner of the helmet to a cheek of a wearer which covers a temple area of a wearer.

12. An environmental assembly according to claim 11, wherein the attaching portion further comprises:

a pair of securing devices for the flap, a first securing device of the pair positioned at a distal end of the flap, a second securing device of the pair positioned adjacent to the main portion, the first and second securing devices of the pair being securable to each other when the flap is folded around the perforate liner to secure the shield to the helmet.

13. An environmental assembly according to claim 11, wherein the main portion further comprises:

a wind retarding extension that covers a side of the face of a wearer including the cheek of a wearer.

14. An environmental assembly according to claim 11, wherein the main portion further comprises:

a bottom that is arcuate and fits evenly around an arcuate back of a wearer.

15. An environmental assembly according to claim 11, wherein the shield forms a pocket between the shield and the body of a wearer to trap air and insulate a chilled wearer.

* * * * *